US011399613B2

(12) United States Patent
Glazenburg et al.

(10) Patent No.: US 11,399,613 B2
(45) Date of Patent: Aug. 2, 2022

(54) EPILATING DEVICE FOR EPILATING HAIR

(71) Applicant: KONINKLIJKE PHILIPS N.V., Eindhoven (NL)

(72) Inventors: Joost Tomas Glazenburg, Groningen (NL); Johannes Beugels, Peize (NL); Johan Kuiper, Bierum (NL); Rogier Enrico De Haas, Hilversum (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/276,520

(22) PCT Filed: Oct. 2, 2019

(86) PCT No.: PCT/EP2019/076758
§ 371 (c)(1),
(2) Date: Mar. 16, 2021

(87) PCT Pub. No.: WO2020/070218
PCT Pub. Date: Apr. 9, 2020

(65) Prior Publication Data

US 2022/0031040 A1 Feb. 3, 2022

(30) Foreign Application Priority Data

Oct. 3, 2018 (EP) ..... 8198436

(51) Int. Cl.
*A45D 26/00* (2006.01)

(52) U.S. Cl.
CPC ..... *A45D 26/0028* (2013.01)

(58) Field of Classification Search
CPC ..... A45D 26/0023; A45D 26/0028; A45D 26/0033; A45D 26/0038; A45D 26/0042; A45D 26/0047; A45D 26/0052
See application file for complete search history.

(56) References Cited

U.S. PATENT DOCUMENTS 6,306,148 B1 10/2001 Knesch
2008/0172070 A1* 7/2008 You ..... A45D 26/0028 606/133

(Continued)

FOREIGN PATENT DOCUMENTS

WO 2010/023629 3/2010

OTHER PUBLICATIONS

International Search Report and Written Opinion dated Nov. 11, 2019 for International Application No. PCT/EP2019/076758 dated Oct. 2, 2019.

*Primary Examiner* — Todd J Scherbel

(57) ABSTRACT

The invention relates to an epilating device (10) for epilating hairs growing from skin, comprising a housing; an epilating system having a plurality of hair-clamping elements arranged adjacent to each other rotatably on a curved supporting shaft which extends in a plane of curvature; a drive system arranged (58) to rotate the hair-clamping elements; a skin-contacting member (16) arranged to contact the skin during use and to be pivotable relative to the housing about a first pivot axis; a compression member arranged adjacent to the epilating system to exert a compression force on the epilating system directed along a compression line, said compression member being pivotable relative to the housing about a second pivot axis to adjust a position of the compression line relative to the housing; and a linkage mechanism linking the skin-contacting member and the compression member such that a pivotal motion of the skin-contacting member about the first pivot axis over a first pivot angle results in a pivotal motion of the compression member about the second pivot axis over a second pivot angle equal to the first pivot angle; wherein the compression member is arranged in a fixed position relative to the curved supporting shaft; and the linkage mechanism links the skin-contacting member (16) and the supporting shaft such that the pivotal (Continued)

motion of the skin-contacting member (16) about the first pivot axis over the first pivot angle results in a pivotal motion of the supporting shaft about the second pivot axis over the second pivot angle.

15 Claims, 6 Drawing Sheets

(56) References Cited

U.S. PATENT DOCUMENTS

| | | | | |
|---|---|---|---|---|
| 2010/0262163 | A1* | 10/2010 | Kindermann ..... | A45D 26/0061 606/133 |
| 2012/0041452 | A1* | 2/2012 | Grieshaber ..... | A45D 26/0061 606/133 |
| 2015/0230580 | A1 | 8/2015 | Hetbrink | |
| 2015/0245696 | A1 | 9/2015 | Hietbrink | |

* cited by examiner

EPILATING DEVICE FOR EPILATING HAIR

CROSS REFERENCE TO RELATED APPLICATIONS

This application is the U.S. National Phase application under 35 U.S.C. § 371 of International Application No. PCT/EP2019/076758 filed Oct. 2, 2019, which claims the benefit of European Patent Application Number 18198436.0 filed Oct. 3, 2018. These applications are hereby incorporated by reference herein.

FIELD OF THE INVENTION

The present invention relates to an epilating device for epilating hairs growing from skin, comprising a skin contour-following mechanism.

BACKGROUND OF THE INVENTION

From U.S. Pat. No. 6,306,148 B1 an epilating device for epilating hairs growing from skin is known that comprises:

a housing;

an epilating system having a plurality of hair-clamping elements arranged adjacent to each other and rotatable relative to the housing;

a drive system arranged to rotate the hair-clamping elements;

a skin-contacting member arranged to contact the skin during use and to be pivotable relative to the housing about a first pivot axis such that, during use, an angular position of the skin-contacting member about the first pivot axis is determined by an angular orientation of the housing relative to a surface of the skin in contact with the skin-contacting member;

a compression member arranged adjacent to the epilating system to exert a compression force on the epilating system directed along a compression line, said compression member being pivotable relative to the housing about a second pivot axis to adjust a position of the compression line relative to the housing; and a linkage mechanism linking the skin-contacting member and the compression member such that a pivotal motion of the skin-contacting member about the first pivot axis over a first pivot angle results in a pivotal motion of the compression member about the second pivot axis over a second pivot angle equal to the first pivot angle.

To obtain an optimum epilation result, the application angle defined as the angle between a longitudinal axis of the epilating device and the surface of the skin should be in a certain range.

In this case the hair-clamping elements are arranged within a rotary cylinder operable by a pressure roller to execute a closing movement of the hair-clamping elements.

The skin-contacting member is arranged pivotably about a first pivot axis. The pressure roller is arranged pivotably about a second pivot axis parallel to the first pivot axis.

To ensure an optimum application angle a linkage mechanism is provided that is capable of adjusting the zone of the closing movement in dependence upon the application angle. The linkage mechanism transmits a pivotal motion of the skin-contacting member about the first pivot axis into a corresponding pivotal motion of the pressure roller about the second pivot axis with the same pivot angle. Thus the linkage mechanism ensures that the epilating system can be moved with the skin-contacting member along a user's skin at varying angles, while the zone of the closing movement of hair-clamping elements is kept at an optimum angle with respect to the user's skin.

A similar epilator known from WO 2010/023629 A2 comprises a movable epilating unit with a skin-contacting member, wherein a stack of hair-clamping elements may be moved pivotably with respect to the skin-contacting member. A predetermined range of angular positions between the stack of hair-clamping elements and the skin contacting surface of the skin-contacting member can be detected. Thus the user may be guided to move the epilator within a predetermined application angle with respect to the skin that should be in a preferred range between 75 and 105 degrees.

However, there are other epilators, such as known from US 2015/0245696 A1 and US 2015/0230580 A1 which use a curved supporting shaft, whereon a stack of hair-clamping elements configured as discs is arranged rotatably. Thus there is a particular angle defined by the curved supporting shaft at which a maximum compression between the hair-clamping elements or discs occurs. For optimum performance, the angle between the curved supporting shaft and a plane defined by the skin-contacting member should be in a predetermined range.

However, if the epilator is moved with respect to the skin-contacting member, the angle may change.

SUMMARY OF THE INVENTION

In view of this it is an object of the present invention to disclose an epilator with a skin contour-following mechanism having a curved supporting shaft wherein a plurality of hair-clamping elements is arranged rotatably that ensures an optimum application angle when the epilator is rotated with respect to the skin-contacting member.

In a first aspect of the present invention there is disclosed an epilating device for epilating hairs growing from skin comprising:

a housing;

an epilating system having a plurality of hair-clamping elements arranged adjacent to each other and rotatable relative to the housing;

a drive system arranged to rotate the hair-clamping elements;

a skin-contacting member arranged to contact the skin during use and to be pivotable relative to the housing about a first pivot axis such that, during use, an angular position of the skin-contacting member about the first pivot axis is determined by an angular orientation of the housing relative to a surface of the skin in contact with the skin-contacting member;

a compression member arranged adjacent to the epilating system to exert a compression force on the epilating system directed along a compression line, said compression member being pivotable relative to the housing about a second pivot axis to adjust a position of the compression line relative to the housing; and a linkage mechanism linking the skin-contacting member and the compression member such that a pivotal motion of the skin-contacting member about the first pivot axis over a first pivot angle results in a pivotal motion of the compression member about the second pivot axis over a second pivot angle equal to the first pivot angle;

wherein the hair-clamping elements are arranged to be rotatable about a supporting shaft which extends along a central axis which is curved in a plane of curvature;

wherein the compression member is arranged in a fixed position relative to the supporting shaft; and wherein the linkage mechanism links the skin-contacting member and the supporting shaft such that the pivotal motion of the skin-contacting member about the first pivot axis over the first pivot angle results in a pivotal motion of the supporting shaft about the second pivot axis over the second pivot angle.

According to the invention it is always ensured that a pivotal motion of the skin-contacting member about the first pivot axis over a first pivot angle results in a corresponding pivotal motion of the compression member over a second pivot angle equal to the first pivot angle.

Further it is ensured that the pivotal motion of the skin-contacting member about the first pivot axis over the first pivot angle results in a corresponding pivotal motion of the supporting shaft about the second pivot axis over the second pivot angle.

Thus, when the skin-contacting member pivots while following a user's skin, then also the curved supporting shaft and the compression member are pivoted accordingly.

Thus, the application angle remains constant and the epilator is always used with an optimum application angle while the compression member acts onto the hair-clamping elements also with an optimum angle.

Preferred embodiments of the invention are defined in the dependent claims.

It will be understood that the invention may not only be used in the given combination of the claims, but also in different combinations or independently, without leaving the scope of the present invention.

According to one embodiment of the invention the second pivot axis crosses the central axis in a first crossing point adjacent to a first end portion of the supporting shaft and in a second crossing point adjacent to a second end portion of the supporting shaft.

This ensures a very simple design.

According to another embodiment of the invention the compression line extends in the plane of curvature.

Thus, the force at which the hairs are pressed together when entering the epilator system and finally being pulled out, increases during the rotating movement of the hair-clamping elements from the skin-contacting member to the line where the hairs are pulled out. This facilitates a good epilation result.

According to another embodiment of the invention the first pivot axis and the second pivot axis coincide.

This ensures a very simple design. The linkage mechanism in this case may be simply a fixed connection without any moving parts.

According to another embodiment of the invention the skin-contacting member, the compression member and the supporting shaft are arranged in mutually fixed positions by the linkage mechanism and are pivotable about the first pivot axis as a unit.

This also ensures a very simple design, since the skin-contacting member, the compression member and the supporting shaft are arranged in a common unit that holds these elements. The common unit may then be pivotable about the coinciding first and second pivot axes. In this case the skin-contacting member may act as the linkage mechanism to which the compression member is fixed so as to pivot together with the supporting shaft about the common first and second pivot axes.

According to another embodiment of the invention the coinciding first and second pivot axes are defined by two bearings by means of which the unit is pivotable relative to the housing.

This allows for an easy construction, in particular with respect to the pivotable support of the pivot axes.

According to another embodiment of the invention the epilating system comprises a driven gear wheel which is rotatable about the coinciding first and second pivot axes, which is arranged to engage a driving gear wheel of the drive system, and which is coupled to the hair-clamping elements to rotate the hair-clamping elements about the supporting shaft.

In this way the drive motion of a drive system can be easily transferred onto the hair-clamping elements to rotate the hair-clamping elements about the supporting shaft.

According to another embodiment of the invention the compression member is configured as a leg spring having at least a middle leg, a first leg extending therefrom at a first end thereof, and a second leg extending from said middle leg at a second end thereof, wherein the middle leg extends along the skin-contacting member in a direction parallel to the first pivot axis, and wherein at least one of the first and second legs engages a fixation plate biasing the hair clamping elements.

By arranging the compression member and the curved supporting shaft in alignment, so that the middle leg is aligned with the skin-contacting member in a direction parallel to the first pivot axis, a very simple construction is achieved that ensures optimum performance. In this case the fixation plate, that moves under the bias exerted by the compression member, ensures that the epilating system during rotation of the hair-clamping elements on the curved support shaft does not get stuck.

According to another embodiment of the invention the skin-contacting member comprises a skin-contacting surface extending in a first direction parallel to the first pivot axis and in a second direction perpendicular to the first direction and arranged to contact the skin during use.

In this way a contour following mechanism allowing to move the epilator along a user's skin can be included in a simple design.

According to another embodiment of the invention the supporting shaft comprises two ends being configured as pivot studs received pivotably within pivot supports.

According to another embodiment of the invention the pivot studs are supported pivotably within openings provided in supporting brackets.

These features facilitate a simple design of the bearings used to support the supporting shaft and the compression member pivotably about coinciding first and second pivot axes.

According to another embodiment of the invention the skin-contacting member comprises a frame surrounding an opening via which the epilating system is accessible for the skin, wherein the skin-contacting surface comprises an outer surface of said frame and surrounds the opening.

This feature facilitates an easy guidance of the skin-contacting member along a user's skin, while allowing easy access to the epilating system.

According to another embodiment of the invention the compression line extends in a compression plane extending through the second pivot axis, and the compression plane and a plane that is perpendicular to the skin-contacting surface enclose an acute angle within a range from 65° to 90°, preferably from 70° to 85°, more preferably between 75° and 80°.

It has been found that these angles lead to optimum epilating results when moving the epilator along a user's skin.

According to another embodiment of the invention the epilating device is configured as a functional unit which can be coupled to and decoupled from a main body of an epilating apparatus, said main body accommodating an electric motor to drive the drive system.

This allows for an easy construction and an easy mounting of the epilating device. In particular, a generic main body that carries the electric motor for driving the epilator can be used in combination with the epilator system. The functional unit may be configured as an exchangeable unit that can be replaced upon wear.

According to another aspect of the invention there is disclosed an epilating apparatus comprising:

a main body accommodating an electric motor; and an epilating device according to any of the embodiments as described here before coupled to the main body; wherein the electric motor is arranged to drive the drive system of the epilating device.

Also this allows for an easy construction and an easy mounting of the epilating apparatus. In particular, the main body that carries the electric motor for driving the epilator can be used in combination with the epilating device.

BRIEF DESCRIPTION OF THE DRAWINGS

These and other aspects of the invention will become apparent from and elucidated with reference to the embodiment described hereinafter.

In the following drawings

DETAILED DESCRIPTION OF THE INVENTION

Figure 1:
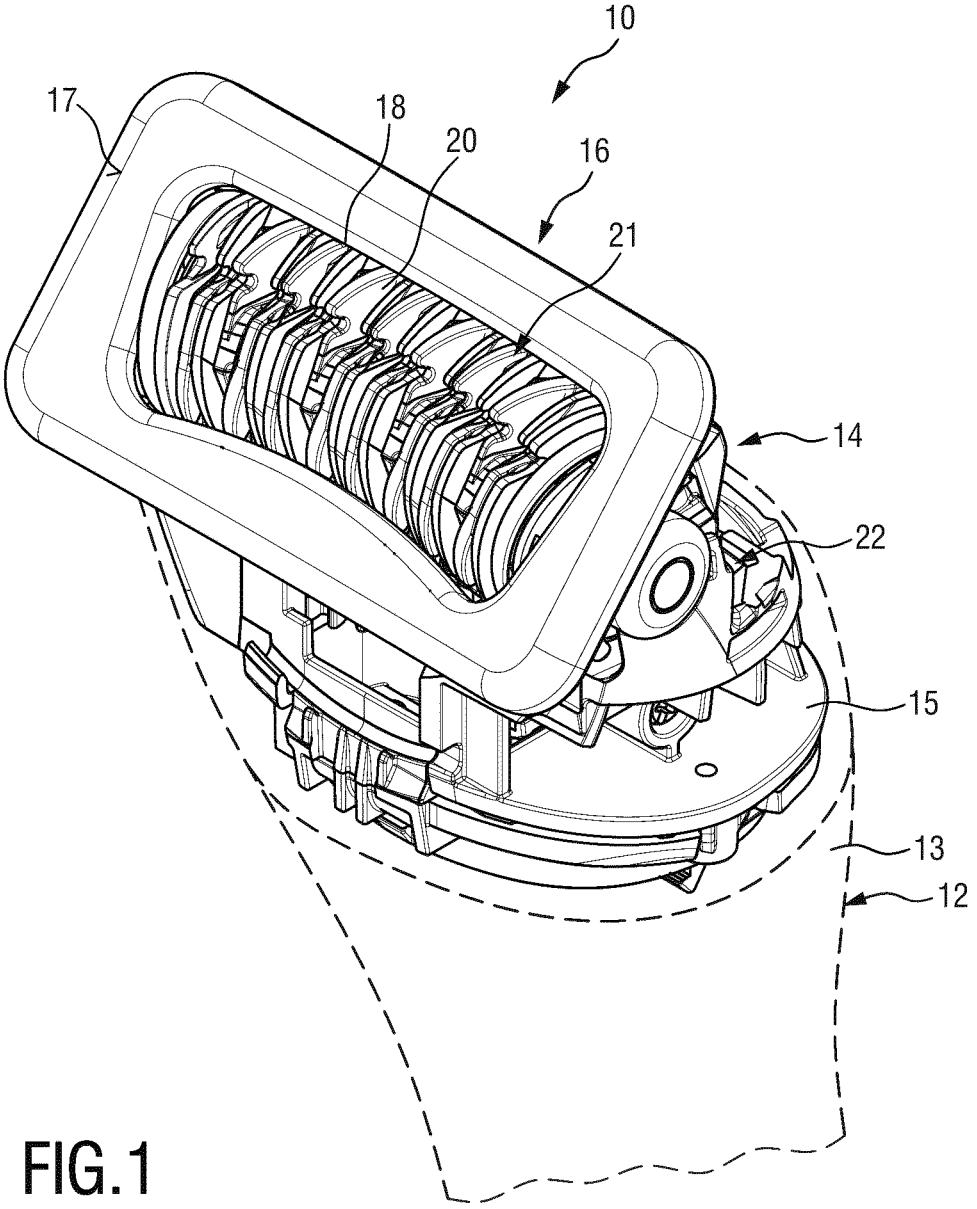
FIG. 1 shows a perspective representation of the upper part of an embodiment of an epilating device according to the invention, wherein a housing of the epilating device is partially cut free.

In FIG. 1 a perspective representation of an epilating device 10 is shown.

The epilating device 10 comprises a housing 12, the periphery of which is shown only partially in dashed lines. Within the housing 12 there is received a main body 13, wherein an electric motor (not shown) for driving the epilator device 10 is received.

An epilating unit 14 is supported on the main body 13 or may be detached therefrom, e.g. in case it needs to be exchanged if worn down.

The epilating unit 14 is supported on a base structure 15 pivotably on pivot bearings 22 (only one of which can be seen in FIG. 1). The base structure 15 is the part that can be attached to or removed from the main body 13 that is secured to the housing 12.

The epilating unit 14 comprises a skin-contacting member 16 having a hair access opening 18 and a skin contacting surface 17. The epilating unit 14 further comprises a stack 21 of hair-clamping elements 20 configured as discs that are arranged rotatably on a curved supporting shaft (not shown).

Figure 2:
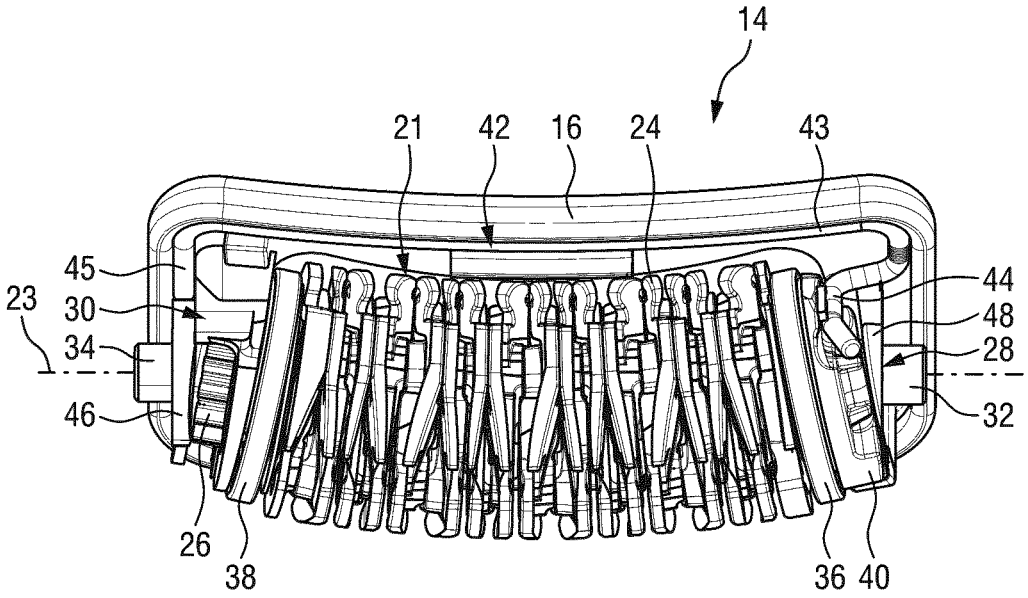
FIG. 2 shows a perspective representation of the epilating device according to FIG. 1 seen from the underside.
Figure 4:
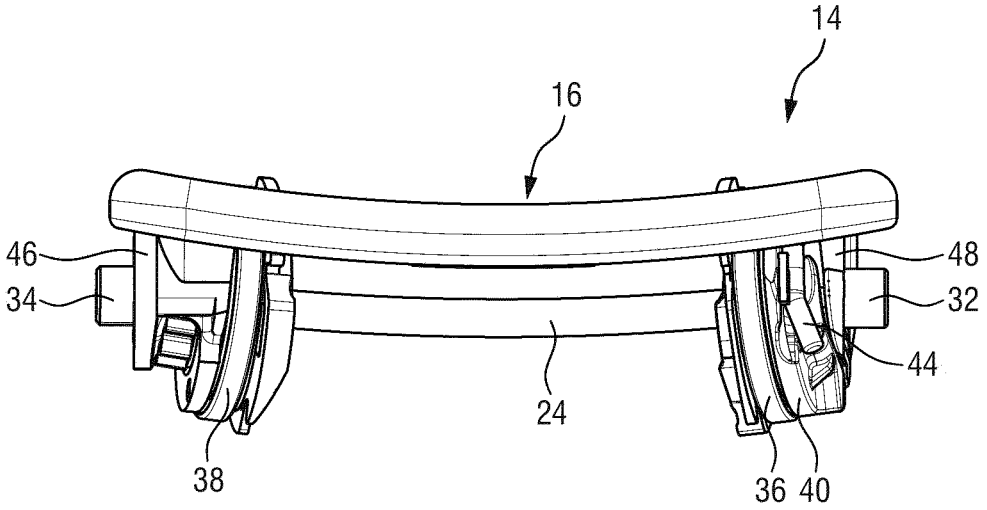
FIG. 4 is a longitudinal view of the epilating device according to FIG. 1, wherein hair-clamping elements of the epilating device are removed to allow a view of a curved supporting shaft of the epilating device.

FIG. 2 shows the epilating unit 14 from the inside. The epilating unit 14 comprises a curved supporting shaft 24 (for details see FIG. 4) that extends at a distance to the skin-contacting member 16 and that is fixed with a certain orientation on two flanges 46, 48 close to the ends 28, 30 of the curved supporting shaft 24. The flanges 46, 48 protrude from the skin-contacting member 16.

From the curved supporting shaft 24 at each end 28, 30 a pivot stud 32, 34 extends to the outside. As will be described later with reference to FIGS. 5 and 6 the epilating unit 14 is secured pivotably with respect to the base structure 15 by supporting the pivot studs 32, 34 in respective openings pivotably that are provided in respective supporting brackets 54, 56 supported on the base structure 15.

Thus the epilating unit 14 in total can be pivoted with respect to the base structure 15, or the housing 12, respectively.

The stack 21 of hair-clamping elements 20 is received on the curved supporting shaft 24 between two end plates 36, 38 (see FIG. 2). At one end, there is a driven gear wheel 26 that is arranged rotatably on the curved supporting shaft 24 coaxially oriented therewith and that engages the end plate 38 for driving the stack 21.

The skin-contacting member 16 comprises a frame 19 as can be seen in FIG. 1. The surface of the frame 19 defines a skin contacting surface 17, whereby the skin-contacting member may be guided along a user's skin. The frame 19 surrounds an opening 18 through which the hair-clamping elements 20 are accessible for the skin to perform an epilation operation.

Figure 3:
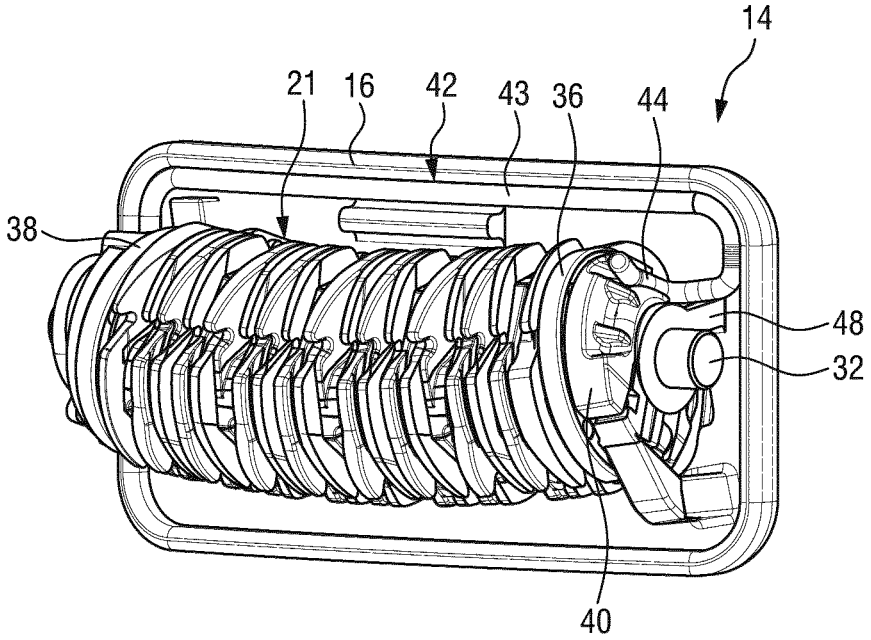
FIG. 3 shows a perspective representation of the epilating device according to FIG. 2 seen from a slightly different direction.

On the skin-contacting member 16 further there is received a compression member 42 which is configured as a leg spring (see FIGS. 2 and 3) having a middle leg 43, a first leg 44 extending from one end thereof and a second leg 45 extending from the other end thereof. The middle leg 43 is secured to the skin-contacting member 16 extending in parallel to the longitudinal extension thereof.

The first leg 44 of the compression member 42 engages a fixation plate 40 that contacts the end plate 36.

The second leg 45 of the compression member 42 is secured to the skin-contacting member 16.

The compression member 42 biases the hair-clamping elements 20 of the stack 21 against each other. During rotation of the stack 21 the fixation plate 40 can yield against the force exerted by the compression member 42, thus allowing a rotation of the hair-clamping elements 20 without locking up.

Figure 5:
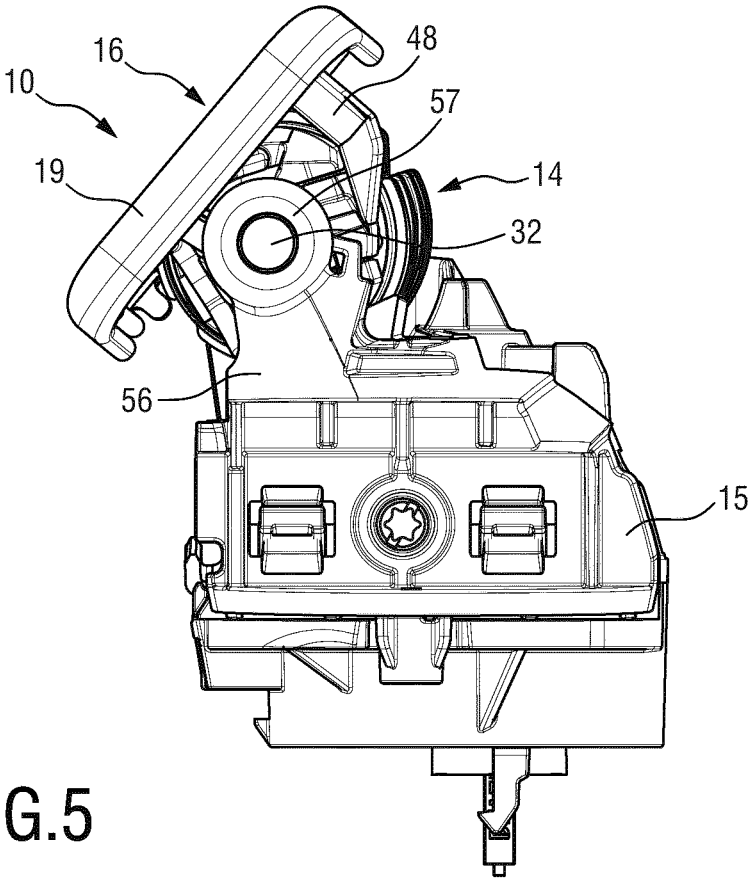
FIG. 5 is a side view of the epilating device according to FIG. 1 from a first side.

From FIG. 5 it can be seen that the epilating unit 14 is received pivotably on the base structure 15. The base structure 15 comprises a supporting bracket 56 protruding therefrom. Within the supporting bracket 56 there is provided an opening 57. The pivot stud 32 of the curved supporting shaft 24 is held pivotably within the opening 57.

Figure 6:
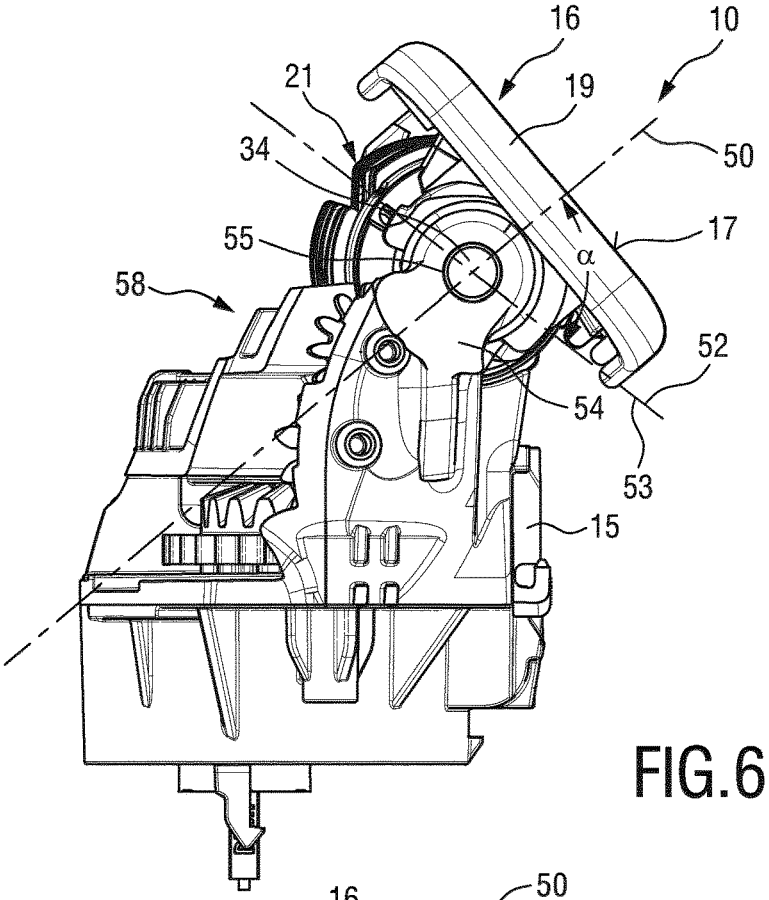
FIG. 6 is a side view of the epilating device according to FIG. 1 from a second side with a skin-contacting member of the epilating device in a first angular position.

As can be seen from FIG. 6 also the other pivot stud 34 of the curved supporting shaft 24 is supported pivotably within an opening 55 of a supporting bracket 54 protruding from the base structure 15.

By the orientation of the curved supporting shaft 24 a plane designated in FIG. 6 with reference numeral 52 is defined.

Figure 10:
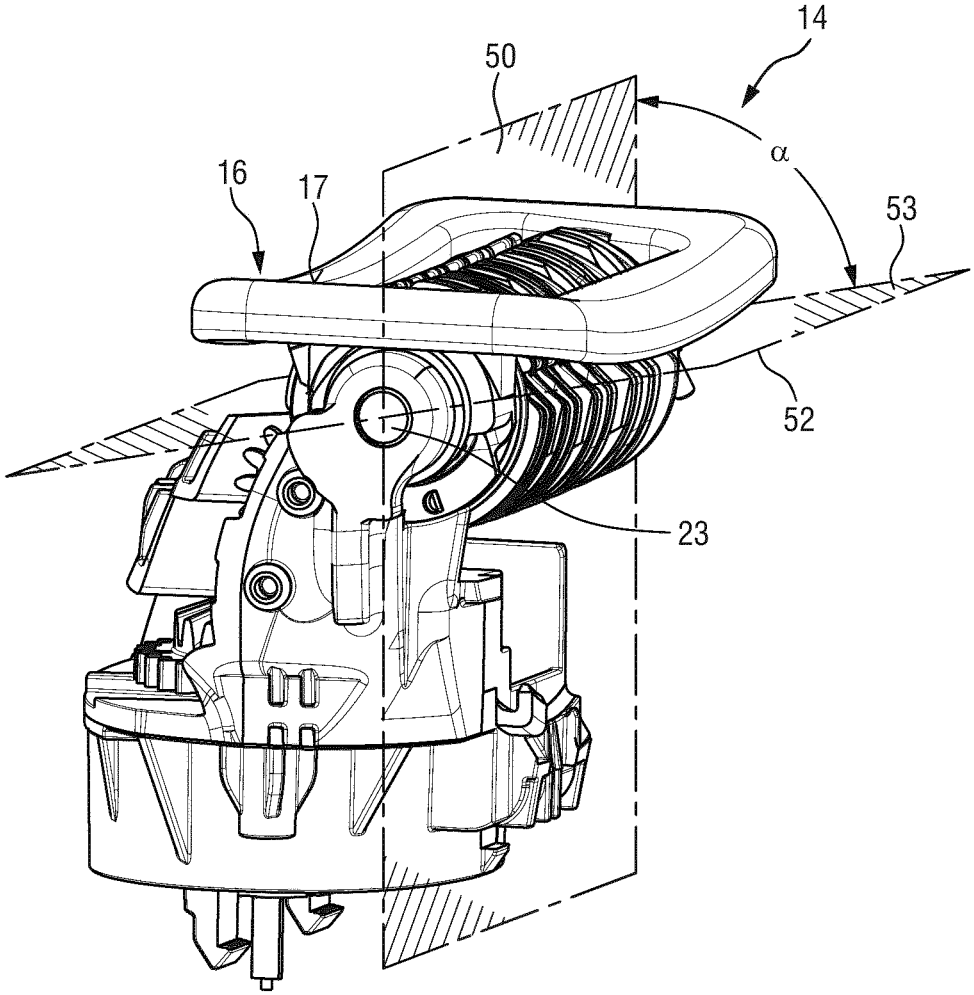
FIG. 10 is a view of the epilating device according to FIG. 1 wherein a mutual orientation of a compression member of the epilating device and the curved supporting shaft is shown.

The compression member 42 with its central leg 43 is fixed on the skin-contacting member 16 and exerts a compression force along a compression line that extends in a compression plane 53 that is shown in FIG. 10. The compression plane 53 extends exactly in the same plane 52 within which the curved supporting shaft 24 is oriented.

Thus when the hair-clamping elements 20 rotate on the curved supporting shaft 24, there is defined a compression line along which the hair-clamping elements 20 are pressed together with maximum force. The compression line defines the compression plane 53 which coincides with the plane 52 defined by the orientation of the curved supporting shaft 24.

Figure 7:
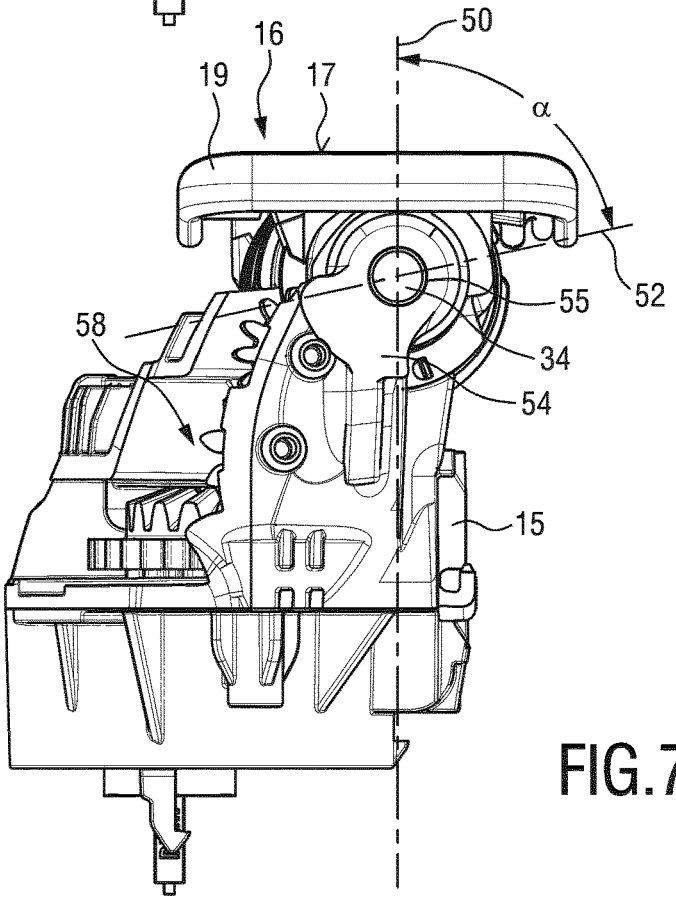
FIG. 7 is a side view according to FIG. 6 with the skin-contacting member in a second angular position.

As can be seen from FIGS. 6 and 7, an angle $\alpha$ is defined between the coinciding planes 52 and 53 defined by the curved supporting shaft 24 and the compression member 42 on the one hand and by a plane 50 that is perpendicular to the skin contacting surface 17 on the other hand.

The angle $\alpha$ defines an application angle of 77.5°, meaning that the hair-clamping elements 20 close 77.5° before the compression line. The compression of the hair-clamping elements 20 or discs does provide the highest hair-clamping element clamping force at the point, to which the curved supporting shaft 24 is directed to. But the hair-clamping elements 20 close 77.5° earlier from that point. The hair-clamping element clamping force increases, as the hair-clamping elements 20 move towards the compression line.

Thus, it is ensured that in any angular position in which a user holds the housing 12 relative to the skin, the stack 21 of hair-clamping elements 20 is always in an optimum position relative to the skin, so as to achieve optimum results during epilation.

In the design described above the skin-contacting member 16, the curved supporting shaft 24, and the compression member 42 are all included in the epilating unit 14 and are all held commonly pivotably about the pivot axis 23 defined by the two pivot bearings 22 that are supported on the base structure 15. In this case the skin-contacting member 16 acts as a linkage mechanism that ensures that the skin-contacting member 16, the curved supporting shaft 24, and the compression member 42 all pivot about the same pivot angle about the pivot axis 23, when the epilator device 10 is moved by guiding the skin-contacting surface 17 thereof along as user's skin.

However, the skin-contacting member 16 could also be arranged pivotably about the first pivot axis 23, while the compression member 42 and the curved supporting shaft 24 could be commonly arranged pivotably about a second pivot axis parallel to the first pivot axis 23. The linkage mechanism would then link the skin-contacting member 16, the compression member 42, and the curved supporting shaft 24 such that the pivotal motion of the skin-contacting member 16 about the first pivot axis 23 over a first pivot angle results in a pivotal motion of the curved supporting shaft 24 and of the compression member 42 about the second pivot axis over a second pivot angle which is equal to the first pivot angle. Also in this way an optimum epilation result would be ensured.

Figure 8:
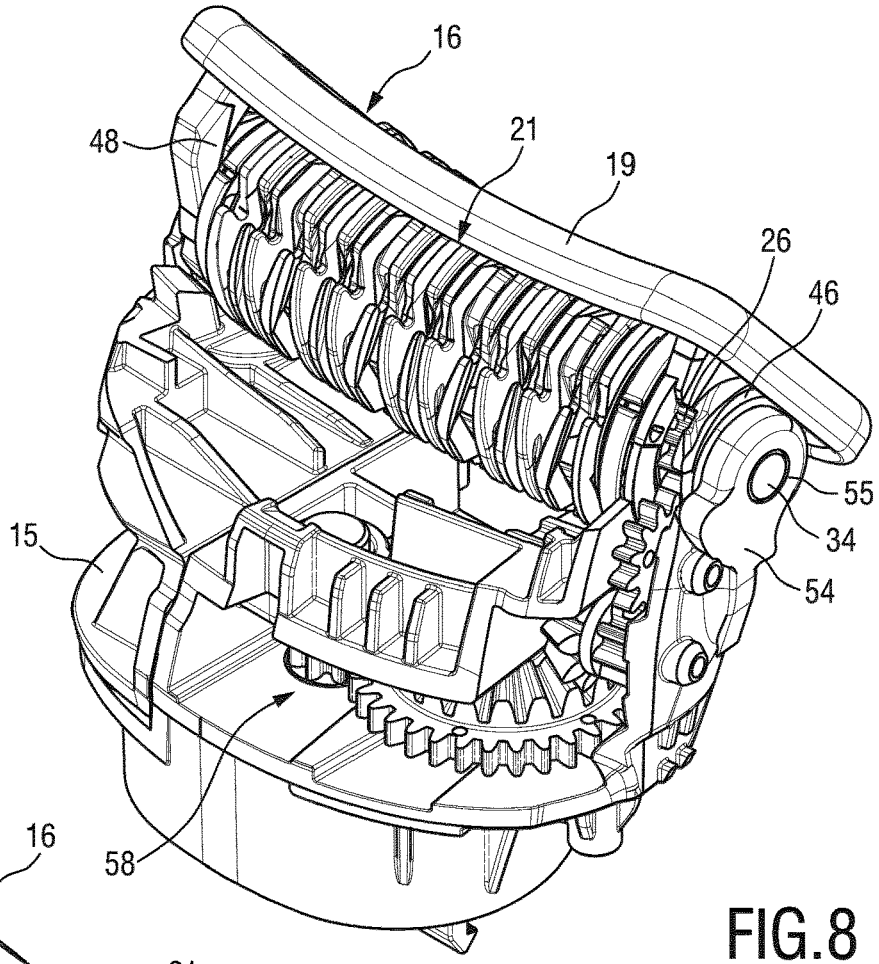
FIG. 8 shows a perspective representation of the epilating device according to FIG. 1 showing a drive system of the epilating device.
Figure 9:
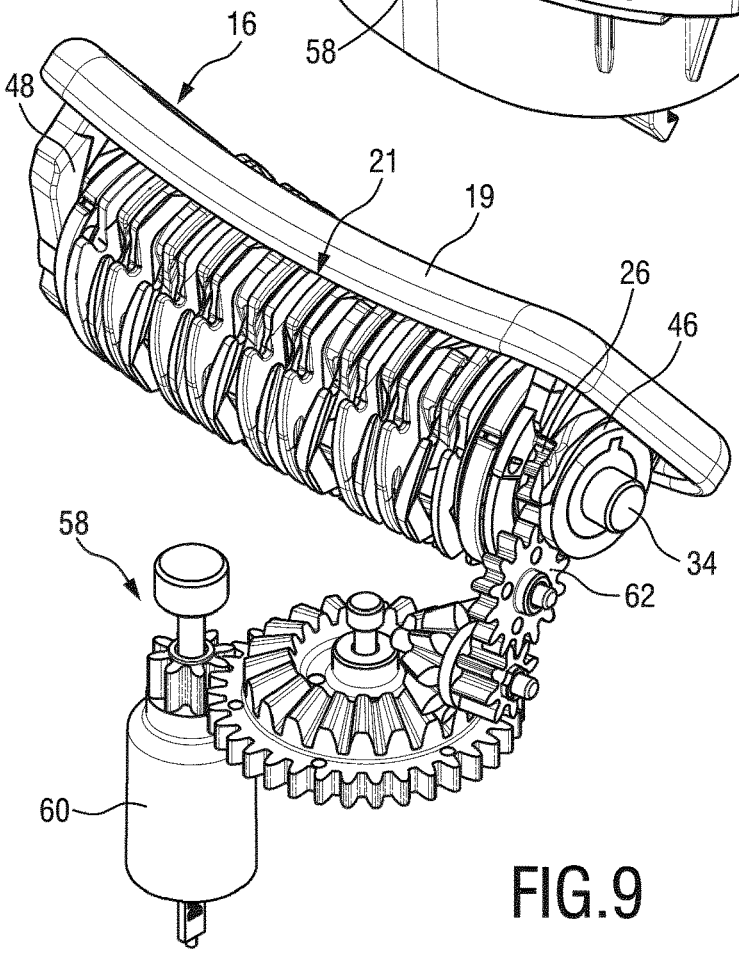
FIG. 9 is a view of the epilating device according to FIG. 8 with some parts being removed to more clearly show the engaging of the drive system with the stack of hair-clamping elements for rotating the hair-clamping elements.

From FIGS. 8 and 9 more details of a drive system 58 that is provided for rotating the stack 21 of hair-clamping elements 20 can be seen.

The drive system 58 is mounted on the base structure 15 and includes a motor 60 that drives a transmission with a plurality of gears meshing with each other. A driving gear wheel 62 of the drive system 58 drives the driven gear wheel 26 that is received on the curved supporting shaft 24.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope of the invention.

The invention claimed is:

1. An epilating device for epilating hairs growing from skin, comprising:

a housing;

an epilating system having a plurality of hair-clamping elements arranged adjacent to each other and rotatable relative to the housing;

a drive system arranged to rotate the hair-clamping elements;

a skin-contacting member arranged to contact the skin during use and to be pivotable relative to the housing about a first pivot axis such that, during use, an angular position of the skin-contacting member about the first pivot axis is determined by an angular orientation of the housing relative to a surface of the skin in contact with the skin-contacting member;

a compression member arranged adjacent to the epilating system to exert a compression force on the epilating system directed along a compression line, said compression member being pivotable relative to the housing about a second pivot axis to adjust a position of the compression line relative to the housing; and a linkage mechanism linking the skin-contacting member and the compression member such that a pivotal motion of the skin-contacting member about the first pivot axis over a first pivot angle results in a pivotal motion of the compression member about the second pivot axis over a second pivot angle equal to the first pivot angle;

characterized in that the hair-clamping elements are arranged to be rotatable about a supporting shaft which extends along a central axis which is curved in a plane of curvature;

the compression member is arranged in a fixed position relative to the supporting shaft; and the linkage mechanism links the skin-contacting member and the supporting shaft such that the pivotal motion of the skin-contacting member about the first pivot axis over the first pivot angle results in a pivotal motion of the supporting shaft about the second pivot axis over the second pivot angle.

2. The epilating device as claimed in claim 1, characterized in that the second pivot axis crosses the central axis in a first crossing point adjacent to a first end portion of the supporting shaft and in a second crossing point adjacent to a second end portion of the supporting shaft.

3. The epilating device as claimed in claim 1, characterized in that the compression line extends in the plane of curvature.

4. The epilating device as claimed in claim 1, characterized in that the first pivot axis and the second pivot axis coincide.

5. The epilating device as claimed in claim 4, characterized in that the skin-contacting member, the compression member and the supporting shaft are arranged in mutually fixed positions by the linkage mechanism and are pivotable about the first pivot axis as a unit.

6. The epilating device as claimed in claim 5, characterized in that the coinciding first and second pivot axes are defined by two bearings by means of which the unit is pivotal relative to the housing.

7. The epilating device as claimed in claim 6, characterized in that the epilating system comprises a driven gear wheel which is rotatable about the coinciding first and second pivot axes, which is arranged to engage a driving gear wheel of the drive system, and which is coupled to the hair-clamping elements to rotate the hair-clamping elements about the supporting shaft.

8. The epilating device as claimed in claim 1, characterized in that said compression member is configured as a leg spring having at least a middle leg, a first leg extending therefrom at a first end thereof, and a second leg extending from said middle leg at a second end thereof, wherein said middle leg extends along said skin-contacting member in a direction parallel to said first pivot axis, and wherein at least one of said first and second legs engages a fixation plate biasing said hair clamping elements.

9. The epilating device as claimed in claim 1, characterized in that the skin-contacting member comprises a skin-contacting surface extending in a first direction parallel to the first pivot axis and in a second direction perpendicular to the first direction and arranged to contact the skin during use.

10. The epilating device of claim 9, characterized in that said supporting shaft comprises two ends being configured as pivot studs received pivotably within pivot supports.

11. The epilating device of claim 10, characterized in that said pivot studs are supported pivotably within openings provided in supporting brackets.

12. The epilating device as claimed in claim 9, characterized in that the skin-contacting member comprises a frame surrounding an opening via which the epilating system is accessible for the skin, wherein the skin-contacting surface comprises an outer surface of said frame and surrounds the opening.

13. The epilating device as claimed in claim 9, characterized in that the compression line extends in a compression plane extending through the second pivot axis, and in that the compression plane and a plane that is perpendicular to the skin-contacting surface enclose an acute angle within a range from 65° to 90°, preferably from 70° to 85°, more preferably between 75° and 80°.

14. The epilating device as claimed in claim 1, characterized in that the epilating device is configured as a functional unit which can be coupled to and decoupled from a main body of an epilating apparatus, said main body accommodating an electric motor to drive the drive system.

15. An epilating apparatus comprising:

a main body accommodating an electric motor; and an epilating device as claimed in claim 1 coupled to the main body;

wherein the electric motor is arranged to drive the drive system of the epilating device.

* * * * *